US009396873B2

(12) United States Patent
Oshima et al.

(10) Patent No.: US 9,396,873 B2
(45) **Date of Patent: *Jul. 19, 2016**

(54) DUST CORE AND METHOD FOR MANUFACTURING THE SAME

(75) Inventors: Yasuo Oshima, Tokyo (JP); Susumu Handa, Tokyo (JP); Kota Akaiwa, Tokyo (JP)

(73) Assignee: Tamura Corporation, Tokyo (JP)

( * ) Notice: Subject to any disclaimer, the term of this patent is extended or adjusted under 35 U.S.C. 154(b) by 865 days.

This patent is subject to a terminal disclaimer.

(21) Appl. No.: 13/132,892

(22) PCT Filed: Apr. 28, 2010

(86) PCT No.: PCT/JP2010/003076

§ 371 (c)(1),
(2), (4) Date: Sep. 21, 2011

(87) PCT Pub. No.: WO2011/077601

PCT Pub. Date: Jun. 30, 2011

(65) Prior Publication Data

US 2012/0001719 A1 Jan. 5, 2012

(30) Foreign Application Priority Data

Dec. 25, 2009 (JP) ..... 2009-296414

(51) Int. Cl.
*H01F 1/24* (2006.01)
*B22F 1/02* (2006.01)
(Continued)

(52) U.S. Cl.
CPC ..... *H01F 41/0246* (2013.01); *H01F 1/26* (2013.01); *H01F 1/33* (2013.01); *B22F 2998/10* (2013.01); *C22C 2202/02* (2013.01); *H01F 1/24* (2013.01); *Y10T 29/49826* (2015.01)

(58) Field of Classification Search
CPC .... B22F 3/02; B22F 2003/248; B22F 1/0059; B22F 1/0003; B22F 9/082; H01F 41/0246; H01F 1/24; H01F 3/08; H01F 27/255; H01F 17/04; H01F 1/33; C22C 1/05; C22C 2202/02
See application file for complete search history.

(56) References Cited

U.S. PATENT DOCUMENTS 6,063,209 A 5/2000 Matsutani et al.
6,284,060 B1 9/2001 Matsutani et al.
(Continued)

FOREIGN PATENT DOCUMENTS

CN 1198577 11/1998
EP 0872856 10/1998
EP 1600987 11/2005
JP 2003-224007 8/2003
(Continued)

OTHER PUBLICATIONS

Machine translation of JP2005-264192A, Sep. 2005.*
(Continued)

*Primary Examiner* — Jie Yang
*Assistant Examiner* — Xiaowei Su

(57) ABSTRACT

Provided is a dust core and a method for manufacturing a thereof, having an effect that the soft magnetic powder is prevented from sintering and bonding together upon heating, the hysteresis loss can be effectively reduced, and the DC B-H characteristics is excellent. In a first mixing process, a soft magnetic powder composed mainly of iron and an inorganic insulating powder of 0.4 wt %-1.5 wt % are mixed by a mixer. A mixture obtained in the first mixing process is heated in a non-oxidizing atmosphere at 1000° C. or more and below a sintering temperature of the soft magnetic powder. In a binder addition process, a silane coupling agent of 0.1-0.5 wt % is added. A binder, e.g. a silicone resin of 0.5-2.0 wt % is added to the soft magnetic alloy powder to which the inorganic insulating powder is attached by the silane coupling agent, and the soft magnetic alloy powders are bonded to each other so as to be granulated. Then, the mixture is added with a lubricant resin and compression-molded so as to form a green compact. In an annealing process, the mold is annealed in a non-oxidizing atmosphere.

10 Claims, 8 Drawing Sheets

(51) Int. Cl.

| | |
|---|---|
| ***B22F 3/16*** | (2006.01) |
| ***H01F 41/02*** | (2006.01) |
| ***H01F 1/26*** | (2006.01) |
| ***H01F 1/33*** | (2006.01) |

(56) References Cited

U.S. PATENT DOCUMENTS

| | | | | |
|---|---|---|---|---|
| 2002/0014280 | A1* | 2/2002 | Moro | 148/104 |
| 2003/0150523 | A1* | 8/2003 | Fujiwara et al. | 148/105 |
| 2005/0257854 | A1 | 11/2005 | Maeda et al. | |
| 2008/0008897 | A1* | 1/2008 | Imagawa et al. | 428/546 |
| 2012/0048063 | A1* | 3/2012 | Maetani | C22C 33/0271 75/246 |
| 2012/0326830 | A1* | 12/2012 | Oshima et al. | 336/221 |

FOREIGN PATENT DOCUMENTS

| | | | | |
|---|---|---|---|---|
| JP | 2004-288983 | | 10/2004 | |
| JP | 2005-015914 | | 1/2005 | |
| JP | 2005-264192 | | 9/2005 | |
| JP | 2005-286145 | | 10/2005 | |
| JP | 2005-336513 | | 12/2005 | |
| JP | 2007-059656 | | 3/2007 | |
| JP | 2009-302165 | | 12/2009 | |
| WO | WO 2008093430 | A1 * | 8/2008 | C22C 33/0271 |

OTHER PUBLICATIONS

Chinese Patent Application No. 201080001075.1 Office Action, 7 pages w/English translation.

European Application No. 10834069.6 Extended European Search Report dated Jan. 2, 2014, 6 pages.

* cited by examiner

DUST CORE AND METHOD FOR MANUFACTURING THE SAME

TECHNICAL FIELD

The present invention relates to a dust core comprising a soft magnetic powder and a method for manufacturing the same.

BACKGROUND ART

A choke coil is used as an electronic equipment, which is employed in a controlling power supply for an office automation equipment, a solar electricity generation system, vehicles, and uninterruptible power supply units. As a core for such choke coil, a ferrite core or a dust core is used. The ferrite core has a disadvantage that the saturation magnetic flux density is small, while the dust core, which is manufactured by molding a metal powder, has a higher saturation magnetic flux density than that of the soft magnetic ferrite, and thus is excellent in DC superposition characteristics.

For meeting the requirements of improving energy conversion efficiency and achieving low heat generation, the dust core is needed to have magnetic properties in which a large magnetic flux density can be obtained by applying a small magnetic field, and further the energy loss can be made low in the variation of magnetic flux density. As a form of energy loss, there is a core loss (iron loss) that occurs when the dust core is used in an alternating magnetic field. The core loss (Pc) is expressed by the sum of a hysteresis loss (Ph) and an eddy current loss (Pe), as shown in the following Equation (1). The hysteresis loss is proportional to the operation frequency, and the eddy current loss (Pe) is proportional to the square of the operation frequency, as shown in the following Equation (2). Therefore, the hysteresis loss (Ph) is dominant in a low-frequency range, while the eddy current loss (Pe) is dominant in a high-frequency range. It is necessary to make the dust core having magnetic properties reducing the occurrence of the core loss (Pc).

$$Pc=Ph+Pe \tag{1}$$

$$Ph=Kh\times f\ Pe=Ke\times f^2 \tag{2}$$

wherein Kh is a hysteresis loss factor, Ke is an eddy current loss factor, and f is a frequency.

In order to reduce the hysteresis loss (Ph) of the dust core, a displacement of a magnetic domain wall should be facilitated by reducing the coercive force of the soft magnetic powder particle. Incidentally, the reduction of the coercive force also achieves the improvement of the initial permeability as well as the reduction of the hysteresis loss. As shown in the following Equation (3), the eddy current loss is inversely proportional to the resistivity of the core.

$$Ke=k1Bm^2t^2/\rho \tag{3}$$

wherein k1 is a factor, Bm is a magnetic flux density, t is a particle size (or thickness of the plate material), and ρ is a resistivity.

From the above reason, pure iron, having small coercive force, has been widely used as soft magnetic powder particle. For example, it is known a method to use the pure iron as soft magnetic powder and making the impurity mass ratio to the soft magnetic powder 120 ppm or less, thereby reducing the hysteresis loss (e.g. see Patent document 1). Also, it is known a method to use the pure iron as soft magnetic powder and make an amount of manganese contained in the soft magnetic powder 0.013 wt % or less, thereby reducing the hysteresis loss (e.g. see Patent document 2). Besides, it is known a method in which the soft magnetic powder is heated before forming an insulation film thereon.

Furthermore, another method is known in which the hysteresis loss is reduced by heating the soft magnetic powder before forming an insulation film thereon. By this method, the stress existed in the soft magnetic particles can be eliminated, the defects in the crystal grain boundary can be eliminated, the crystal particles in the soft magnetic powder particles can be grown (enlarged), therefore a displacement of a magnetic domain wall should be facilitated and thus the coercive force of the soft magnetic powder particle can be reduced. For example, it is known a method in which heating process is performed in an inert atmosphere at 800° C. or more to a soft magnetic powder composed mainly from iron, containing 2-5 wt % Si, having average particle size of 30-70 μm, and having an average aspect ratio of 1-3. By this method, the crystal particles in the powder particles can be enlarged and the coercive force can be reduced, and thus the hysteresis loss can be reduced (see Patent document 3). Also, it is known a method in which the metal particles are mixed with spacer particles and the metal particles are separated from each other, thereby preventing the metal particles from sintering and bonding to each other (e.g. see Patent document 4).

Patent document 1: Japanese Patent Application Laid-open No. 2005-15914

Patent document 2: Japanese Patent Application Laid-open No. 2007-59656

Patent document 3: Japanese Patent Application Laid-open No. 2004-288983

Patent document 4: Japanese Patent Application Laid-open No. 2005-336513

DISCLOSURE OF THE INVENTION

However, the inventions disclosed in Patent documents 1 and 2 have a problem that when annealing a green compact obtained by pressure-molding, heating must be performed at low-temperature where the insulation film formed on the surface of the soft magnetic powder is not thermally decomposed. However, by this temperature, the hysteresis loss cannot be effectively reduced.

Moreover, the invention disclosed in Patent document 3 also has a problem, that is, when pure iron is used as the soft magnetic particles, the soft magnetic particles must be mechanically pulverized for preventing the particles from sintering and bonding to each other. On that occasion, however, a new stress is generated interior of the soft magnetic particles. In the invention disclosed in Patent document 4, there is a problem that the metal particles must be separated from the spacer particles after heating, thereby lacking convenience. Additionally, there is also a problem that the metal particles are magnetized since a magnet is used upon separation.

It is an object of the present invention to solve the above problems. That is to say, it is an object to provide a dust core and a method for manufacturing thereof, in which an inorganic insulating powder with the melting point of 1500° C. or more is uniformly dispersed, thereby achieving a convenient method for preventing the soft magnetic powder from sintering and bonding to each other during heating and reducing the hysteresis loss effectively. Moreover, by uniformly dispersing the inorganic insulating powder, gaps between magnetic powders are uniformly distributed. As a result, DC superposition characteristics can be improved.

To achieve the above object, the present invention provides a dust core comprising a mixture of a soft magnetic powder and an inorganic insulating powder, the mixture being heated, added with a binder resin, mixed with a lubricant resin, and compression-molded so as to form a mold, and the mold being annealed, wherein an added amount of the inorganic insulating powder is 0.4-1.5 wt and the mixture is heated in a non-oxidizing atmosphere at 1000° C. or more and also below a sintering temperature of the soft magnetic powder.

In another aspect of the present invention, the soft magnetic powder has an average particle size of 5-30 μm, and contains 0-6.5 wt % silicon. In still another aspect of the present invention, the inorganic insulating powder is $Al_2O_3$ powder or MgO powder having a melting point of 1500° C. or more, and has an average particle size of 7-500 nm. The present invention also provides a method for manufacturing the above-described dust core.

According to the present invention, by uniformly dispersing an inorganic insulating fine powder with the melting point of 1500° C. or more, it is possible to make the particles of the soft magnetic powder separate with each other upon heating the powder, thereby preventing the soft magnetic powder particles from sintering and bonding together.

BEST MODE FOR CARRYING OUT THE INVENTION

[1. Manufacturing Process]

Figure 1:
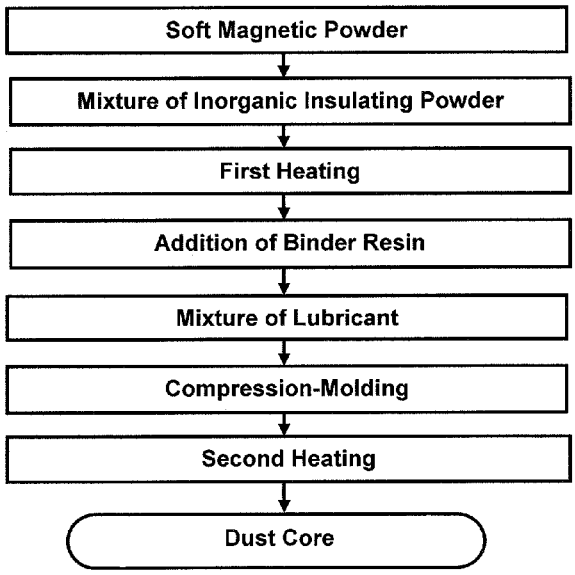
FIG. 1 is a flowchart showing a method for manufacturing a dust core according to one embodiment.

A method for manufacturing a dust core according to the present invention comprises the following processes shown in FIG. 1:

(1) a first mixing process in which the soft magnetic powder is mixed with the inorganic insulating powder (Step 1);

(2) a heating process in which a mixture obtained in the first mixing process is heated (Step 2);

(3) a binder addition process in which a binder resin is added to the soft magnetic powder and the inorganic insulating powder after the heating process (Step 3);

(4) a second mixing process in which the soft magnetic powder and the inorganic insulating powder added with the binder resin is mixed with a lubricant resin (Step 4);

(5) a molding process in which a mixture obtained in the second mixing process is compression-molded so as to form a green compact (Step 5); and (6) an annealing process in which the green compact obtained in the molding process is annealed (Step 6).

In the following, the above processes will be explained in detail respectively.

(1) First Mixing Process

In the first mixing process, a soft magnetic powder composed mainly of iron is mixed with an inorganic insulating powder.

[Soft Magnetic Powder]

In the embodiment, a soft magnetic powder prepared by gas atomization method, water/gas atomization method, or water atomization method, having an average particle size of 5-30 μm, and containing 0.0-6.5 wt % silicon is used. When the average particle size is beyond the range of 5-30 μm, the eddy current loss (Pe) is increased. In contrast, when the average particle size is below the range of 5-30 μm, the hysteresis loss (Ph) due to density reduction is increased. Moreover, in the soft magnetic powder, the preferable content of silicon is 6.5 wt % or less. When the content exceeds this value, the moldability is deteriorated, which causes a decrease in the magnetic properties due to density reduction of the dust core.

When the soft magnetic alloy powder is prepared by the water atomization method, the soft magnetic powder becomes amorphous, and the surface of the powder becomes uneven. Therefore, it is difficult to uniformly distribute the inorganic insulating powder on the surface of the soft magnetic powder. Furthermore, upon molding, stress concentrates on projecting portions of the powder surface, which often results in an insulation breakdown. Therefore, for mixing the soft magnetic powder with the inorganic insulating powder, an apparatus applying a mechanochemical effect on the powder is used, such as a V-type mixer, a W-type mixer, and a pot mill. In addition, a mixer which may apply a mechanical force, such as a compression force and a shear force can be used to mix the powder and modify the surface of the soft magnetic powder at the same time.

Moreover, DC superposition characteristics are proportional to the aspect ratio of the powder. By the above processing, the aspect ratio can be made between 1.0-1.5. For this purpose, a surface smoothing treatment is performed on a mixed powder obtained by mixing the soft magnetic powder with the inorganic insulating powder, so as to uniformly cover the surface of the magnetic powder by inorganic insulating powder and make the rough surface even. This surface smoothing treatment is performed by plastically deform the surface in mechanical manner. As for example, a mechanical alloying apparatus, a ball mill, an attritor or the like is used.

[Inorganic Insulating Powder]

An average particle size of the inorganic insulating powder to be mixed with the magnetic powder is 7-500 nm. If the average particle size is less than 7 nm, granulation becomes difficult, while if the average particle size exceeds 500 nm, the inorganic insulating powder cannot cover the surface of the soft magnetic powder uniformly, so that insulation properties cannot be retained. Furthermore, the added amount of the inorganic insulating powder is preferably in the range of 0.4-1.5 wt % with respect to the soft magnetic powder. If the amount is less than 0.4 wt %, sufficient properties cannot be achieved, while the amount exceeds 1.5 wt %, the density is distinctively decreased so that magnetic properties are reduced. As to such inorganic insulating material, it is preferable to use at least one or more of the materials having a melting point of 1500° C. or more, that is, MgO (melting point: 2800° C.), $Al_2O_3$ (melting point: 2046° C.), $TiO_2$ (melting point: 1640° C.), CaO powder (melting point: 2572° C.).

(2) Heating Process

In a heating process, in order to reduce the hysteresis loss as well as heighten the annealing temperature after the molding, the mixture obtained in the above first mixing process is heated in a non-oxidizing atmosphere at 1000° C. or more and also below the sintering temperature of the soft magnetic powder. The non-oxidizing atmosphere may be a reducing atmosphere such as a hydrogen gas, an inert atmosphere, and a vacuum atmosphere. That is, it is preferable that the atmosphere is not an oxidizing atmosphere.

In this process, the insulating layer, which has been formed in the first mixing process by the inorganic insulating powder uniformly covering the surface of the soft magnetic alloy powder, can prevent the powders from fusing with each other upon heating. Moreover, by heating at the temperature of 1000° C. or more, the stress existed in the soft magnetic particles can be eliminated, the defects in the crystal grain boundary etc. can be eliminated, and the crystal particles in the soft magnetic powder particles can be grown (enlarged), which results in facilitating a displacement of a magnetic domain wall, decreasing the coercive force and reducing the hysteresis loss. In contrast, if the heating is performed at the sintering temperature of the soft magnetic powder, the soft magnetic powder is sintered and bonded to each other and thus cannot be used as a material of the dust core. Therefore, it is necessary to perform the heating below the sintering temperature of the soft magnetic powder.

(3) Binder Addition Process

An object of the binder addition process is to uniformly disperse the inorganic insulating powder on the surface of the soft magnetic alloy powder. According to the present embodiment, two kinds of materials are added. As a first additive, a silane coupling agent is used. The silane coupling agent is added for the purpose of strengthening the adhesion between the inorganic insulating powder and soft magnetic powder. The added amount of the agent is preferably in the range of 0.1-0.5 wt % with respect to the soft magnetic powder. If the amount is below the range, the adhesion effect is insufficient. On the contrary, if the amount is in excess of the range, a decrease in formed density occurs, which results in deteriorating magnetic properties after the annealing. As a second additive, a silicone resin is used. The silicone resin serves as a binder for granulation to bind the soft magnetic alloy powders with each other, which have been attached with the inorganic insulating powder by the silane coupling agent. Additionally, this silicone resin is added for the purpose of preventing the core wall surface from generating longitudinal streaks due to the contact between a metal mold and the powders upon molding. The added amount of the silicone resin is preferably in the range of 0.5-2.0 wt % with respect to the soft magnetic powder. If the amount is below the range, the core wall surface generates the longitudinal streaks upon molding. On the contrary, if the amount is in excess of the range, a decrease in formed density occurs, which results in deteriorating magnetic properties after the annealing.

(4) Second Mixing Process

In a second mixing process, the mixture obtained in the above binder addition process is mixed with a lubricant resin for the purpose of reducing punching pressure of an upper punch upon molding and preventing the core wall surface from generating the longitudinal streaks due to the contact between the metal mold and the powders. As a lubricant to be mixed in this process, a wax such as stearic acid, stearate, stearic acid soap, and ethylene-bis-stearamide can be used. By adding such material, the slidability between granulated powders can be enhanced, the density upon mixing can be enhanced, and thus the formed density can be improved. Moreover, it becomes possible to prevent the powders from sintering in the metal mold. Mixing amount of the lubricant resin is 0.2-0.8 wt % with respect to the soft magnetic powder. If the amount is below the range, sufficient effect cannot be achieved, that is, the longitudinal streaks are generated on the core wall surface upon molding, punching pressure becomes higher, and at worst, the upper punch cannot be extracted. On the contrary, if the amount is in excess of the range, a decrease in formed density occurs, which results in deteriorating magnetic properties after the annealing.

(5) Molding Process

In the molding process, the soft magnetic powder added with the binder resin as described above is injected into the metal mold and molded by single-shaft molding using a floating die method. At this time, the pressed and dried binder resin acts as a binder upon molding. As similar to the conventional invention, molding pressure is preferable about 1500 MPa according to the present invention.

(6) Annealing Process

In the annealing process, a green compact obtained by the molding is annealed in a non-oxidizing atmosphere such as $N_2$ gas or $N_2$+$H_2$ gas at more than 600° C. temperature to manufacture a dust core. When the annealing temperature becomes too high, magnetic properties are deteriorated due to the deterioration of insulating properties. Especially, since the eddy current loss is largely increased, increase of the core loss cannot be restricted.

During the annealing, the binder resin thermally decomposes at a certain temperature. The hysteresis loss of the dust core due to oxidation will not increase even if heated at high-temperature, since heating is performed in the nitrogen atmosphere.

[2. Measurement Items]

As the measurement items, the magnetic permeability, the maximum magnetic flux density, and the DC superposition characteristics are measured by the following method. The magnetic permeability is calculated from the inductance at 20 kHz, 0.5V by winding a primary coil of 20 turns around the manufactured dust core and using a impedance analyzer (Agilent Technologies, Inc: 4294A).

A primary coil (20 turns) and a secondary coil (3 turns) were wound around the dust core. The core loss thereof is calculated by using a B-H analyzer (Iwatsu Test Instruments Corp.: SY-8232) which is a magnetic measurement apparatus under the condition of frequency 10 kHz, the maximum magnetic flux density Bm=0.1T. The calculation was made by using the following Equation 4, in which the hysteresis loss and the eddy current were calculated from the frequency of the core loss by using the least squares method.

$$Pc=Kh\times f+Ke\times f2$$

$$Ph=Kh\times f$$

$$Pe=Ke\times f2 \quad \text{(Equation 4)}$$

Pc: core loss
Kh: hysteresis loss factor
Ke: eddy current loss factor
f: frequency
Ph: hysteresis loss
Pe: eddy current loss

EXAMPLES

Examples 1-21 of the embodiment will be explained with reference to FIGS. 1-4.

[3-1. First Characteristics Comparison (Comparison of the Heating Temperature in the Heating Process)]

In a first characteristics comparison, comparison was made with respect to the surface modification of the soft magnetic powder depending on the heating temperature in the heating process. As shown in Table 1, comparison was made to the temperature supplied to the powder in the heating process of Examples 1-3 and Comparative Example 1. Table 1 shows evaluations of the soft magnetic powder determined by a X-ray diffraction method (hereinafter, referred to as "XRD") for each heating temperature applied to the soft magnetic powder.

In Examples 1-3 and Comparative Example 1, Fe—Si alloy powder prepared by the gas atomization method, having an average particle size of 22 μm and silicon content of 3.0 wt %, is added with 0.4 wt % $Al_2O_3$ as the inorganic insulating powder, which has an average particle size of 13 nm (specific surface area: 100 $m^2/g$). Then, Samples of Examples 1-3 are heated for 2 hours at 950° C.-1150° C. in a reducing atmosphere containing 25% hydrogen (the remaining 75% is nitrogen).

Figure 2:
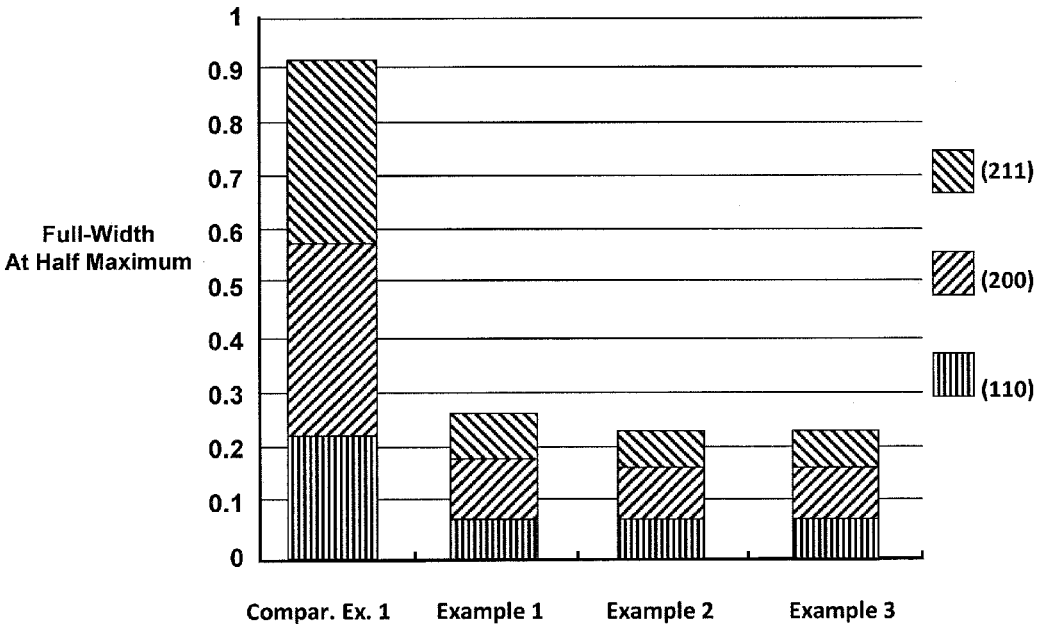
FIG. 2 is a diagram showing a sum of full-widths at half maximum of respective surfaces (110), (200) and (211) in a first characteristics comparison.

With respect to Examples 1-3 and Comparative Example 1, Table 1 shows an evaluation of the full-width at half maximum made to the peaks of respective surfaces (110), (200), (211) by using XRD. FIG. 2 shows a sum of full-width at half maximum of respective surfaces (110), (200) and (211) in Examples 1-3 and Comparative Example 1, respectively.

TABLE 1

| | First heating | Full-width at half maximum | | |
|---|---|---|---|---|
| | Temperature (° C.) | (110) | (200) | (211) |
| Comparative Example 1 | — | 0.2349 | 0.334 | 0.345 |
| Example 1 | 1050 | 0.0796 | 0.094 | 0.080 |
| Example 2 | 1100 | 0.0773 | 0.077 | 0.080 |
| Example 3 | 1150 | 0.0783 | 0.076 | 0.081 |

As can be seen from Table 1 and FIG. 2, each value of the full-width at half maximum of XRD peaks in the surfaces (110), (200), (211) becomes large in Comparative Example 1 without the heating process. The full-width at half maximum becomes higher as the stress of the powder becomes larger, is bigger, while the full-width at half maximum becomes lower as the stress becomes smaller. Therefore, in Comparative Example 1, there exists a large stress in the powder. In Examples 1-3 containing heating process, in contrast to Comparative Example 1, each value of the full-width at half maximum of the XRD peaks in the surfaces (110), (200), and (211) is small. This is because the stress existed in the powder is eliminated by heating the powder in the heating process. Furthermore, though not shown in Table 1, a similar effect can be achieved when the heating process is performed at 1000° C. or more.

It is understood that surface modification of the soft magnetic powder can be made by heating the soft magnetic powder at 1000° C. or more. By this way, the surface roughness of the magnetic powder can be eliminated, and thus the magnetic flux concentrates into a small gap area between the magnetic powders, and the magnetic flux density in the vicinity of the contacting point becomes large, thereby preventing the increase of the hysteresis loss. Therefore, the gaps between the magnetic powders become dispersed gaps so that DC superposition characteristics can be improved. However, when the heating is performed at the sintering temperature of the soft magnetic powder, there is a problem that the soft magnetic powder is sintered and bonded together so that it cannot be used as a material of the dust core. Therefore, the heating must be performed at the temperature below the sintering temperature of the soft magnetic powder.

From the above fact, the heating temperature in the heating process is determined as 1000° C. or more and also below the sintering temperature of the soft magnetic powder. By this way, the soft magnetic powder is prevented from sintering and bonding to each other upon heating. Accordingly, it is possible to provide the dust core and the manufacture method thereof which reduces the hysteresis loss effectively.

[3-2. Second Characteristics Comparison (Comparison of the Added Amount of the Inorganic Insulating Material)]

In a second characteristics comparison, comparison is made to the amount of the inorganic insulating material added to the Fe—Si alloy powder containing 3.0 wt % silicon. Table 2 shows kinds and contents of the inorganic insulating materials added to the soft magnetic powder in Examples 4-14 and Comparative Examples 2-6. As shown in Table 2, $Al_2O_3$ having the average particle size of 13 nm (specific surface area: 100 $m^2/g$), $Al_2O_3$ of 60 nm (specific surface area: 25 $m^2/g$), and MgO of 230 nm (specific surface area: 160 $m^2/g$) were used as the inorganic insulating materials.

Samples used in this characteristics comparison were prepared by adding the inorganic insulating powder as shown below to the Fe—Si alloy powder containing 3.0 wt % silicon which was prepared by the gas atomization method and has the average particle size of 22 μm.

In Comparative Example 2 of item A, the inorganic insulating powder was not added.

In Comparative Examples 3, 4 of item B, 0.20-0.25 wt % $Al_2O_3$ of 13 nm (specific surface area: 100 $m^2/g$) was added as the inorganic insulating powder.

Furthermore, in Examples 4-10, 0.40-1.50 wt % $Al_2O_3$ of 13 nm (specific surface area: 100 $m^2/g$) was added as the inorganic insulating powder.

In Comparative Example 5 and Examples 11-13 of item C, 0.25-1.00 wt % $Al_2O_3$ of 60 nm (specific surface area: 25 $m^2/g$) was added as the inorganic insulating powder. In Comparative Example 6 and Example 14 of item D, 0.20-0.70 wt % MgO of 230 nm (specific surface area: 160 $m^2/g$) was added as the inorganic insulating powder.

Subsequently, those samples were heated by keeping in a reducing atmosphere of 25%—hydrogen (remaining 75%—nitrogen) at 1100° C. for 2 hours. Moreover, 0.25 wt % silane coupling agent and 1.2 wt % silicone resin were mixed in this order. The mixed samples were dried by heating (180° C.; 2 hours), and then added with 0.4 wt % zinc stearate as a lubricant and mixed together.

The samples were compression-molded at room-temperature under 1500 MPa pressure so that dust cores, having ring-shape of outer diameter: 16 mm, inner diameter: 8 mm, and height: 5 mm were manufactured. Then, those dust cores are annealed in the nitrogen atmosphere ($N_2$+$H_2$) at 625° C. for 30 minutes.

Figure 3:
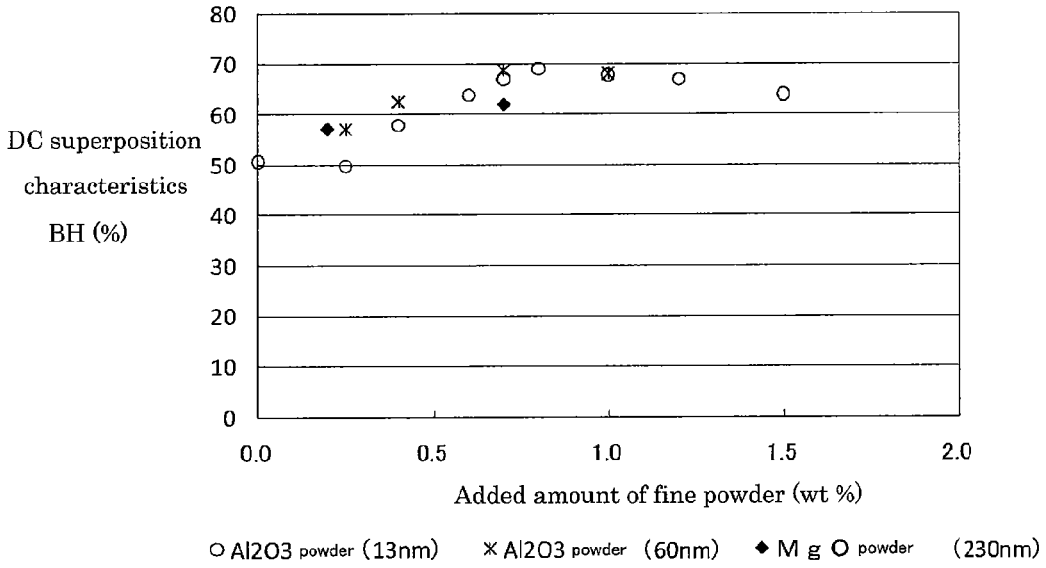
FIG. 3 is a diagram showing a relationship of the DC superposition characteristics with respect to the added amount of the fine powder in a second characteristics comparison.
Figure 4:
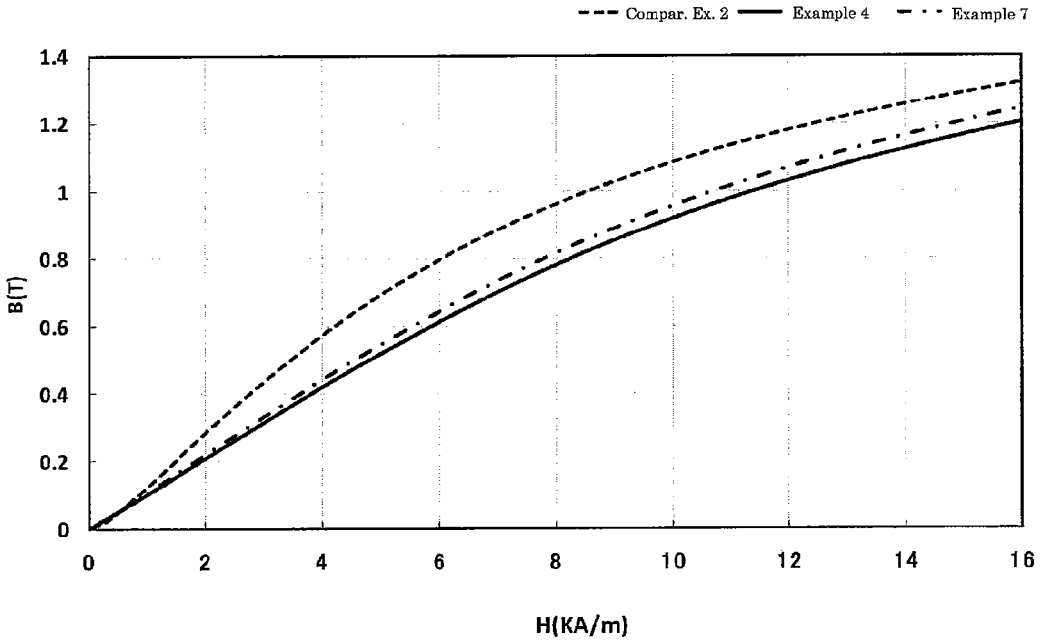
FIG. 4 is a diagram showing DC B-H characteristics of the direct current of the dust core in the second characteristics comparison.
Figure 5:
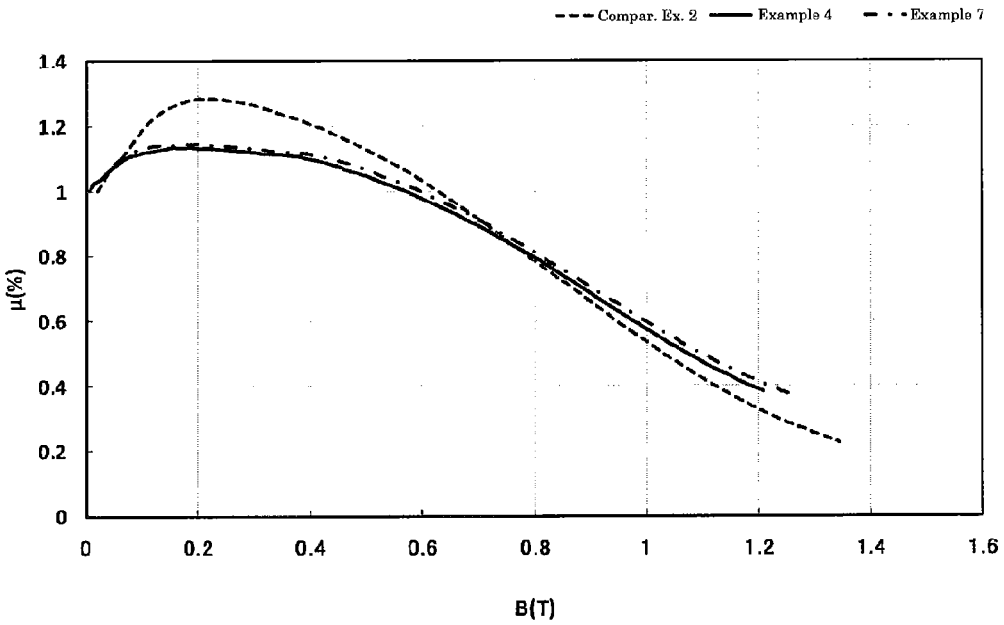
FIG. 5 is a diagram showing a relationship between the differential permeability and the magnetic flux density in view of the DC B-H characteristics in a second characteristics comparison.

Table 2 shows correlations between kinds of the soft magnetic powder and the inorganic insulating powder, added amount thereof, temperature of the first heating, magnetic permeability, and core loss per unit volume in Examples 4-14 and Comparative Examples 2-6. FIG. 3 shows relations between the added amount of the fine powder and the DC superposition characteristics in Examples 4-14 and Comparative Examples 2-6. FIG. 4 shows the DC B-H characteristics in Examples 4, 7 and Comparative Example 2. FIG. 5 shows relations between the differential permeability and the magnetic flux density attained from the DC B-H characteristics shown in FIG. 4.

[DC B-H Characteristics]

In Table 2, among the columns regarding the DC B-H characteristics, "percentage" means the ratio of the magnetic permeability μ in magnetic flux density 1T to the magnetic permeability μ in magnetic flux density 0T (μ(1T)/μ(0T)). Larger value of this percentage means superior DC superposition characteristics. That is, as can be seen from Table 2, in Comparative Examples 3, 4 and Examples 4-10 of item B, Comparative Example 5 and Examples 11-13, and Comparative Example 6 and Example 14 of item D where the soft magnetic powder containing 3.0 wt %—Si was prepared by the gas atomization method, the DC B-H characteristics were improved since 0.4 wt % or more fine powder was added.

In contrast, with regard to the magnetic flux density and the magnetic permeability, comparison is made between item A without the fine powder and items B-D adding the with the fine powder shown in Table 2. The magnetic permeability is reduced due to the decrease of the density caused by adding the fine powder. Therefore, the DC B-H characteristics were deteriorated. Especially, when the fine powder is added more than 1.5 wt %, the magnetic flux density is decreased in a large amount so that the DC B-H characteristics are deteriorated.

[Hysteresis Loss]

Regarding the hysteresis loss (Ph) shown in Table 2, the hysteresis loss (Ph) at 10 kHz is more reduced in Examples

TABLE 2

| | First insulating layer Insulating powder | | | | | | |
|---|---|---|---|---|---|---|---|
| Item | kind | specific surface area m2/g | particle size nm | added amount wt % | First heating ° C. | Second heating ° C. | |
| A | — | — | — | — | — | 725 | Compar. Ex. 2 |
| B | Al2O3 | 100 | 13 | 0.25 | 1100 | 725 | Compar. Ex. 3 |
| | | | | 0.25 | 1100 | 725 | Compar. Ex. 4 |
| | | | | 0.40 | 1100 | 725 | Example 4 |
| | | | | 0.60 | 1100 | 725 | Example 5 |
| | | | | 0.70 | 1100 | 725 | Example 6 |
| | | | | 0.80 | 1100 | 725 | Example 7 |
| | | | | 1.00 | 1100 | 725 | Example 8 |
| | | | | 1.20 | 1100 | 725 | Example 9 |
| | | | | 1.50 | 1100 | 725 | Example 10 |
| C | Al2O3 | 25 | 60 | 0.25 | 1100 | 725 | Compar. Ex. 5 |
| | | | | 0.40 | 1100 | 725 | Example 11 |
| | | | | 0.70 | 1100 | 725 | Example 12 |
| | | | | 1.00 | 1100 | 725 | Example 13 |
| D | MgO | 160 | 230 | 0.20 | 1100 | 725 | Compar. Ex. 6 |
| | | | | 0.70 | 1100 | 725 | Example 14 |

| | | Density of magnetized | Core loss (KW/m3) | | | DC B-H characteristics | | | Magnetic | |
|---|---|---|---|---|---|---|---|---|---|---|
| | Density | portion | 100 mT@10 kHz | | | μi | | | permeability | |
| Item | g/cm3 | % | Pc | Ph | Pe | B = 0T | B = 1T | % | decrease | |
| A | 7.08 | 93.5 | 115 | 108 | 8 | 100 | 51 | 50.7 | 100.0 | Compar. Ex. 2 |
| B | 7.10 | 93.4 | 93 | 81 | 8 | 85 | 44 | 52.6 | 84.6 | Compar. Ex. 3 |
| | 7.06 | 92.9 | 101 | 90 | 9 | 73 | 36 | 49.8 | 72.6 | Compar. Ex. 4 |
| | 7.08 | 93.0 | 91 | 82 | 8 | 75 | 43 | 57.9 | 75.1 | Example 4 |
| | 7.06 | 92.6 | 89 | 80 | 8 | 67 | 43 | 63.9 | 67.3 | Example 5 |
| | 7.03 | 92.1 | 87 | 78 | 9 | 62 | 42 | 66.9 | 62.3 | Example 6 |
| | 7.00 | 91.6 | 86 | 74 | 9 | 60 | 41 | 69.1 | 60.1 | Example 7 |
| | 6.97 | 91.0 | 82 | 72 | 9 | 58 | 40 | 67.8 | 58.3 | Example 8 |
| | 6.95 | 90.6 | 79 | 70 | 8 | 57 | 38 | 66.9 | 57.5 | Example 9 |
| | 6.88 | 89.4 | 78 | 69 | 8 | 49 | 31 | 63.9 | 48.7 | Example 10 |
| C | 7.08 | 93.2 | 86 | 74 | 10 | 72 | 41 | 57.0 | 72.1 | Compar. Ex. 5 |
| | 7.09 | 93.2 | 74 | 65 | 10 | 66 | 42 | 62.6 | 66.4 | Example 11 |
| | 7.05 | 92.3 | 66 | 58 | 9 | 60 | 42 | 68.8 | 60.4 | Example 12 |
| | 7.02 | 91.7 | 66 | 56 | 10 | 57 | 39 | 68.1 | 57.3 | Example 13 |
| D | 7.08 | 93.3 | 103 | 93 | 12 | 80 | 45 | 57.2 | 79.5 | Compar. Ex. 6 |
| | 7.00 | 91.8 | 90 | 85 | 8 | 63 | 39 | 62.0 | 63.1 | Example 14 |

4-14 and Comparative Examples 3-6 each adding $Al_2O_3$ as inorganic insulating material than Comparative Example 1 without the inorganic insulating powder. Therefore, it is understood that magnetic properties are improved as a whole.

In general, as the density becomes higher, the hysteresis loss becomes smaller. However, in Examples 4-14, the hysteresis loss (Ph) is remained small though the density shows the low value. This is because when the fine powder is unequally dispersed on the surface of the soft magnetic powder, the magnetic flux concentrates into a small gap area between the magnetic powders, and the magnetic flux density in the vicinity of the contacting point becomes large, which becomes one of the causes increasing the hysteresis loss. In Examples, however, the fine powders were uniformly dispersed and gaps between the magnetic powders becomes uniform, thereby reducing the hysteresis loss caused by the concentration of the magnetic flux into the gap between the magnetic powders. Accordingly, the hysteresis loss (Ph) can be made small, though the density is remained low. Furthermore, by uniformly dispersing the inorganic insulating powder, the gaps between the magnetic powders become dispersion gaps, therefore DC superposition characteristics can be improved.

As described above, 0.4-1.5 wt % is the preferable range of the amount of the inorganic insulating material added to the soft magnetic powder, i.e. the Fe—Si alloy powder containing 3.0 wt % silicon. If the amount is below this range, sufficient effect cannot be achieved. If the amount is more than 1.5 wt %, it results in a deterioration of the DC B-H characteristics due to density reduction. In the above range, even if the soft magnetic powder contains 3.0 wt % silicon, the powders are prevented from sintering and bonding to each other. As a result, it is possible to provide a dust core effectively reducing the hysteresis loss and also a manufacturing method thereof.

[3-3. Third Characteristics Comparison (Comparison of the Added Amount of the Inorganic Insulating Material)]

In a third characteristics comparison, comparison is made with respect to the amount of the inorganic insulating material added to the Fe—Si alloy powder containing 6.5 wt % silicon. Table 3 shows kinds and contents of the inorganic insulating materials added to the soft magnetic powder in Examples 15-18 and Comparative Examples 7-9. The average particle size of the inorganic insulating material, i.e. $Al_2O_3$ is 13 nm (specific surface area: 100 $m^2/g$)

Samples used in this characteristics comparison were prepared by adding the inorganic insulating powder as shown below to the Fe—Si alloy powder prepared by the gas atomization method, having average particle size of 22 μm, and containing 3.0 wt % silicon, and then mixing them by a V-type mixer for 30 minutes.

In Comparative Example 7 of item E, the inorganic insulating powder was not added.

In Comparative Examples 8, 9 of item F, 0.15-0.25 wt % $Al_2O_3$ of 13 nm (specific surface area: 100 $m^2/g$) was added, as the inorganic insulating powder.

In Examples 15-18, 0.40-1.00 wt % $Al_2O_3$ of 13 nm (specific surface area: 100 $m^2/g$) was added as the inorganic insulating powder.

Subsequently, those samples were heated by keeping in a reducing atmosphere of 25%—hydrogen (remaining 75%—nitrogen) at 1100° C. for 2 hours. Moreover, 0.25 wt % silane coupling agent and 1.2 wt % silicone resin were mixed in this order. The mixed samples were dried by heating (180° C.; 2 hours), and then added with 0.4 wt % zinc stearate as a lubricant and mixed together.

The samples were compression-molded at room-temperature under 1500 MPa pressure so that dust cores, having ring-shape of outer diameter: 16 mm, inner diameter: 8 mm, and height: 5 mm were manufactured. Then, those dust cores are annealed in the nitrogen atmosphere ($N_2$ 90%; $H_2$ 10%) at 625° C. for 30 minutes.

Figure 6:
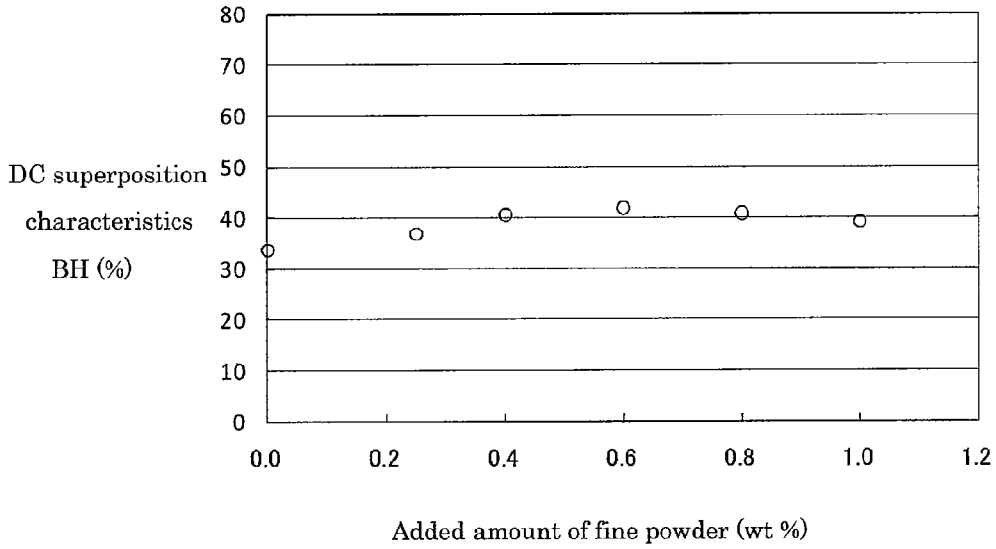
FIG. 6 is a diagram showing a relationship of the DC superposition characteristics with respect to the added amount of the fine powder in a third characteristics comparison.

Table 3 shows correlations between kinds of the soft magnetic powder and the inorganic insulating powder, added amount thereof, temperature of the first heating, magnetic permeability, and core loss per unit volume in Examples 15-18 and Comparative Examples 7-9. FIG. 6 shows relations between the added amount of the fine powder and the DC superposition characteristics in Examples 15-18 and Comparative Examples 8, 9.

TABLE 3

| | First insulating layer Insulating powder | | | | | | |
|---|---|---|---|---|---|---|---|
| Item | kind | specific surface area m2/g | particle size nm | added amount wt % | First heating ° C. | Second heating ° C. | |
| E | — | — | — | — | — | 725 | Compar. Ex. 7 |
| F | Al2O3 | 100 | 13 | 0.15 | 1100 | 725 | Compar. Ex. 8 |
| | | | | 0.25 | 1100 | 725 | Compar. Ex. 9 |
| | | | | 0.40 | 1100 | 725 | Example 15 |
| | | | | 0.60 | 1100 | 725 | Example 16 |
| | | | | 0.80 | 1100 | 725 | Example 17 |
| | | | | 1.00 | 1100 | 725 | Example 18 |

| | | Density of magnetized | Core loss (KW/m3) | | | DC B-H characteristics | | | Magnetic | |
|---|---|---|---|---|---|---|---|---|---|---|
| | Density | portion | 100 mT@10 kHz | | | μi | | | permeability | |
| Item | g/cm3 | % | Pc | Ph | Pe | B = 0T | B = 1T | % | decrease | |
| E | 6.70 | 91.6 | 106 | 98 | 7 | 98 | 33 | 33.7 | 100.0 | Compar. Ex. 7 |
| F | 6.72 | 91.7 | 89 | 80 | 8 | 82 | 30 | 36.3 | 83.7 | Compar. Ex. 8 |
| | 6.73 | 91.6 | 83 | 75 | 8 | 76 | 28 | 36.9 | 77.7 | Compar. Ex. 9 |
| | 6.68 | 90.9 | 81 | 73 | 8 | 68 | 28 | 40.6 | 69.9 | Example 15 |
| | 6.65 | 90.3 | 80 | 71 | 8 | 63 | 27 | 41.9 | 64.9 | Example 16 |
| | 6.58 | 89.1 | 74 | 65 | 8 | 57 | 23 | 40.9 | 58.4 | Example 17 |
| | 6.53 | 88.3 | 73 | 64 | 8 | 54 | 21 | 39.2 | 55.6 | Example 18 |

[DC B-H Characteristics]

In Table 3, among the columns regarding the DC B-H characteristics, "percentage" means the ratio of the magnetic permeability μ in magnetic flux density 1T to the magnetic permeability μ in magnetic flux density 0T (μ(1T)/μ(0T)). Larger value of this percentage means superior DC superposition characteristics. That is, as can be seen from Table 3 and FIG. 6, in Comparative Examples 8, 9 and Examples 15-18 of item F where the soft magnetic powder containing 6.5 wt %—Si was prepared by the gas atomization method, the DC B-H characteristics were improved since the fine powder was added 0.4 wt % or more.

In contrast, comparison is made between item E without the fine powder and item F adding with the fine powder with respect to the magnetic flux density and the magnetic permeability as shown in Table 3 and FIG. 6. The magnetic permeability was reduced due to the decrease of the density caused by adding the fine powder. Therefore, the DC B-H characteristics were deteriorated. Especially, when the fine powder was added more than 1.5 wt %, the magnetic flux density was reduced in a large amount so that the DC B-H characteristics were deteriorated.

[Hysteresis Loss]

Regarding the hysteresis loss (Ph) shown in Table 3, the hysteresis loss (Ph) at 10 kHz was more reduced in Examples 15-18 and Comparative Examples 8, 9 each adding $Al_2O_3$ as inorganic insulating material than Comparative Example 7 without the inorganic insulating powder. Therefore, it is understood that the magnetic properties were improved as a whole.

In general, as the density becomes higher, the hysteresis loss becomes smaller. However, in Examples 15-18, the hysteresis loss (Ph) was remained small though the density show the low value. This is because when the fine powder is unequally dispersed on the surface of the soft magnetic powder, the magnetic flux concentrates into a small gap area between the magnetic powders, and the magnetic flux density in the vicinity of the contacting point becomes large, which becomes one of the causes increasing the hysteresis loss. In Examples, however, the fine powders were uniformly dispersed, and gaps between the magnetic powders becomes uniform, thereby reducing the hysteresis loss caused by the concentration of the magnetic flux into the gap between the magnetic powders. Accordingly, the hysteresis loss (Ph) can be made small, though the density shows low value. Furthermore, by uniformly dispersing the inorganic insulating powder, the gaps between the magnetic powders become dispersion gaps, therefore DC superposition characteristics can be improved.

As described above, 0.4-1.5 wt % is the preferable rage of the amount of the inorganic insulating material added to the soft magnetic powder, i.e., the Fe—Si alloy powder containing 6.5 wt % silicon. f the amount is below this range, sufficient effect cannot be achieved. If the amount is more than 1.5 wt %, it results in a deterioration of the DC B-H characteristics due to density reduction. In the above range, even if the soft magnetic powder contains 6.5 wt % silicon, the powders are prevented from sintering and bonding to each other. As a result, it is possible to provide a dust core effectively reducing the hysteresis loss and also a manufacturing method thereof.

[3-4. Fourth Characteristics Comparison (Comparison of the Kinds of the Soft Magnetic Alloy Powder)]

In a fourth characteristics comparison, comparison is made with respect to the kinds of the soft magnetic powder added with the inorganic insulating powder. Soft magnetic powder used in this comparison is the Fe—Si alloy powder, containing 1 wt % silicon having particle size of 63 μm or less prepared by the water atomization method, as well as a pure iron having a circularity of 0.85 and prepared by smoothing a surface of a pure iron of particle size 75 μm or less made by the water atomization method.

Samples used in this characteristics comparison were prepared as shown below.

In Example 19 of item G, a pure iron having particle size 75 μm or less and prepared by the water atomization method was added with $Al_2O_3$ of 13 nm (specific surface area: 100 $m^2/g$) as inorganic insulating material, and mixed by a V-type mixer for 30 minutes.

In Example 20 of item H, the surface smoothing treatment was performed on a pure iron having particle size 75 μm or less and prepared by the water atomization method so as to have a circularity of 0.85, and added with $Al_2O_3$ of 13 nm (specific surface area: 100 $m^2/g$) as inorganic insulating material, and mixed by a V-type mixer for 30 minutes.

In Example 21 of item I, a Fe—Si alloy powder of particle size 63 μm or less and containing 1 wt % silicon which was prepared by the water atomization method is added with $Al_2O_3$ of 13 nm (specific surface area: 100 $m^2/g$) as inorganic insulating material, and mixed by a V-type mixer for 30 minutes.

Subsequently, those samples were heated by keeping in a reducing atmosphere of 25%—hydrogen (remaining 75%—nitrogen) at 1100° C. for 2 hours. Moreover, 0.25 wt % silane coupling agent, 1.2 wt % silicone resin were mixed in this order. The mixed samples were dried by heating (180° C.; 2 hours), and then added with 0.4 wt % of zinc stearate as lubricant and mixed together.

The samples were compression-molded at room-temperature under 1500 MPa pressure so that dust cores, having ring-shape of outer diameter: 16 mm, inner diameter: 8 mm, and height: 5 mm were manufactured. Then, those dust cores are annealed in the nitrogen atmosphere ($N_2$ 90%; $H_2$ 10%) at 625° C. for 30 minutes.

Figure 7:
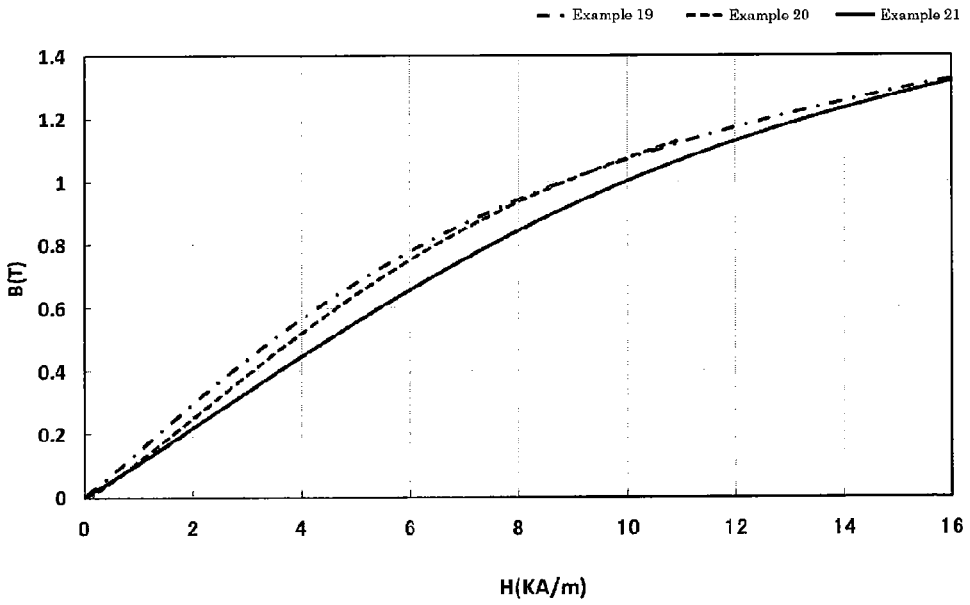
FIG. 7 is a diagram showing the DC B-H characteristics of the dust core in a fourth characteristics comparison.
Figure 8:
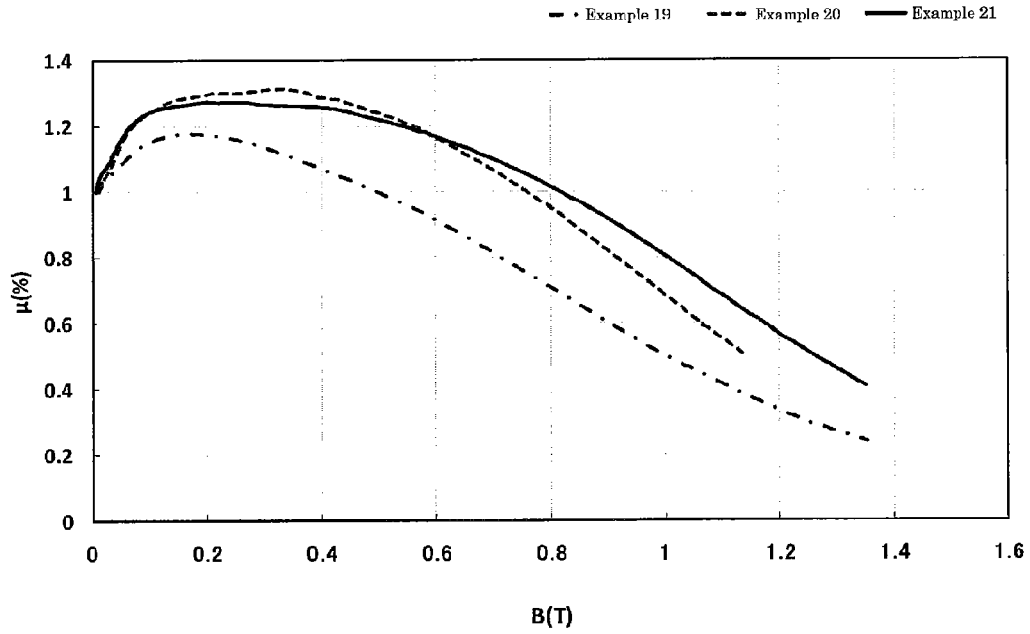
FIG. 8 is a diagram showing a relationship between the differential permeability and the magnetic flux density in view of the DC B-H characteristics in a fourth characteristics comparison.

Table 4 shows correlations between kinds of the soft magnetic powder and the inorganic insulating powder, added amount thereof, temperature of the first heating, magnetic permeability, and core loss per unit volume in Examples 19-21. FIG. 7 shows DC B-H characteristics in Examples 19-21, and FIG. 8 shows relations between the differential permeability and the magnetic flux density attained from the DC B-H characteristics shown in FIG. 7.

TABLE 4

| | First insulating layer Insulating powder | | | | | | |
|---|---|---|---|---|---|---|---|
| Item | kind | specific surface area m2/g | particle size nm | added amount wt % | First heating ° C. | Second heating ° C. | |
| G | Al2O3 | 100 | 13 | 0.75 | 1100 | 650 | Example 19 |
| H | | | | 0.50 | 1100 | 650 | Example 20 |
| I | | | | 0.50 | 1100 | 650 | Example 21 |

TABLE 4-continued

| Item | Density g/cm3 | Density of magnetized portion % | Core loss (KW/m3) 100 mT@10 kHz Pc | Ph | Pe | DC B-H characteristics μi B = 0T | B = 1T | % | Magnetic permeability decrease | |
|---|---|---|---|---|---|---|---|---|---|---|
| G | 7.21 | 90.9 | 96 | 72 | 20 | 103 | 53 | 51.1 | 73.5 | Example 19 |
| H | 7.20 | 91.0 | 98 | 80 | 18 | 84 | 57 | 68.1 | 60.2 | Example 20 |
| I | 7.12 | 90.0 | 98 | 78 | 16 | 71 | 58 | 80.6 | 71.4 | Example 21 |

[DC B-H Characteristics]

In Table 4, among the columns regarding the DC B-H characteristics, "percentage" means the ratio of the magnetic permeability μ in magnetic flux density 1T to the magnetic permeability μ in magnetic flux density 0T (μ(1T)/μ(0T)). Larger value of this percentage means superior DC superposition characteristics. That is, as can be seen from Table 4, in Examples 19, 20 without Si and in Example 21 with 1.0 wt % Si where the soft magnetic powder containing 3.0 wt %—Si was prepared by the gas atomization method, the DC B-H characteristics were improved since the inorganic insulating powder was added. This is similar to the soft magnetic powder, containing 3.0-6.5 wt % Si and prepared by the gas atomization method. Furthermore, when comparing Examples 20 and 21 of FIG. 8, it is understood that DC superposition characteristics were improved by the surface smoothing treatment.

As can be seen from FIGS. 7 and 8, the relative magnetic permeability in the applied magnetic field is superior in Example 20 with the surface smoothing treatment of the soft magnetic powder than in Example 19 without the surface smoothing treatment. By smoothing the surface of the soft magnetic powder, the surface roughness can be eliminated so that the powder can be made near to the spherical shape. Accordingly, a dust core with high density can be manufactured even by the low pressure. The dust core has a property that the DC superposition characteristics become superior as the density becomes higher. Therefore, it is understood that in Examples, DC superposition characteristics were improved by making the density of the dust core higher.

As described above, by using Fe—Si alloy powder containing 0-6.5 wt % silicon as the soft magnetic alloy powder, a dust core with decreased loss can be provided. In addition, the dust core achieves high density and superior DC superposition characteristics. Furthermore, by the surface smoothing treatment, the dust core can achieve further higher density and superior DC superposition characteristics.

[3-5. Fifth Characteristics Comparison (Comparison of the Annealing Temperature)]

The following J-L granulated powders were compression-molded under 1500 MPa pressure so that dust cores, having ring-shape of outer diameter: 16 mm, inner diameter: 8 mm, and height: 5 mm were manufactured. Then, those dust cores are annealed in a non-oxidizing atmosphere of 90%—$N_2$ gas and 10%—hydrogen gas at 400-750° C. for 30 minutes. The results are shown in Table 5.

[Granulated Powder J]

A water-atomized pure iron powder of 75 μm or less was added with 0.75 wt % alumina powder having average particle size of 13 nm and specific surface area of 100 $m^2$/g as the insulating powder, mixed by a V-type mixer for 30 minutes, and then heated by keeping in a hydrogen atmosphere of 25%—hydrogen and 75%—nitrogen at 1100° C. for 2 hours. The sample was mixed with a binder, that is, 0.5 wt % silane coupling agent and 1.5 wt % silicone resin in this order. The mixed sample was dried by heating at 150° C. for 2 hours, and then added with 0.4 wt % zinc stearate as a lubricant and mixed together.

[Granulated Powder K]

A water-atomized pure iron powder of 75 μm or less was coated with a phosphate film, mixed with a binder, that is, 0.5 wt %—silane coupling agent and 1.5 wt %—the silicone resin in this order. The mixed sample was dried by heating at 150° C. for 2 hours, and then added with 0.4 wt %—zinc stearate as a lubricant and mixed together.

[Granulated Powder L]

A water-atomized pure iron powder of 75 μm or less was coated with a phosphate film, and added with 0.4 wt %—zinc stearate as a lubricant and mixed together.

TABLE 5

| Item | Heating temperature ° C. | Density g/cm3 | Magnetic permeability 20 kHz | Core loss (KW/m3) 150 mT@20 kHz Pc | Ph | Pe | |
|---|---|---|---|---|---|---|---|
| J | 500 | 7.31 | 94 | 813 | 644 | 163 | Example 24 |
| | 550 | 7.33 | 97 | 756 | 553 | 192 | Example 25 |
| | 600 | 7.33 | 108 | 702 | 501 | 195 | Example 26 |
| | 650 | 7.32 | 110 | 695 | 495 | 197 | Example 27 |
| | 700 | 7.31 | 113 | 680 | 478 | 198 | Example 28 |
| | 725 | 7.33 | 116 | 685 | 480 | 203 | Example 29 |
| | 750 | 7.34 | 117 | 1334 | 702 | 608 | Example 30 |
| K | 400 | 7.53 | 100 | 1118 | 916 | 193 | Compar. Ex. 8 |
| | 525 | 7.52 | 110 | 966 | 737 | 217 | Compar. Ex. 9 |
| | 550 | 7.53 | 119 | 951 | 720 | 221 | Compar. Ex. 10 |
| | 575 | 7.53 | 122 | 3080 | 1303 | 1734 | Compar. Ex. 11 |
| L | 400 | 7.62 | 106 | 1060 | 856 | 203 | Compar. Ex. 12 |
| | 500 | 7.62 | 132 | 992 | 702 | 276 | Compar. Ex. 13 |
| | 525 | 7.63 | 123 | 5413 | 1669 | 3671 | Compar. Ex. 14 |

Figure 9:
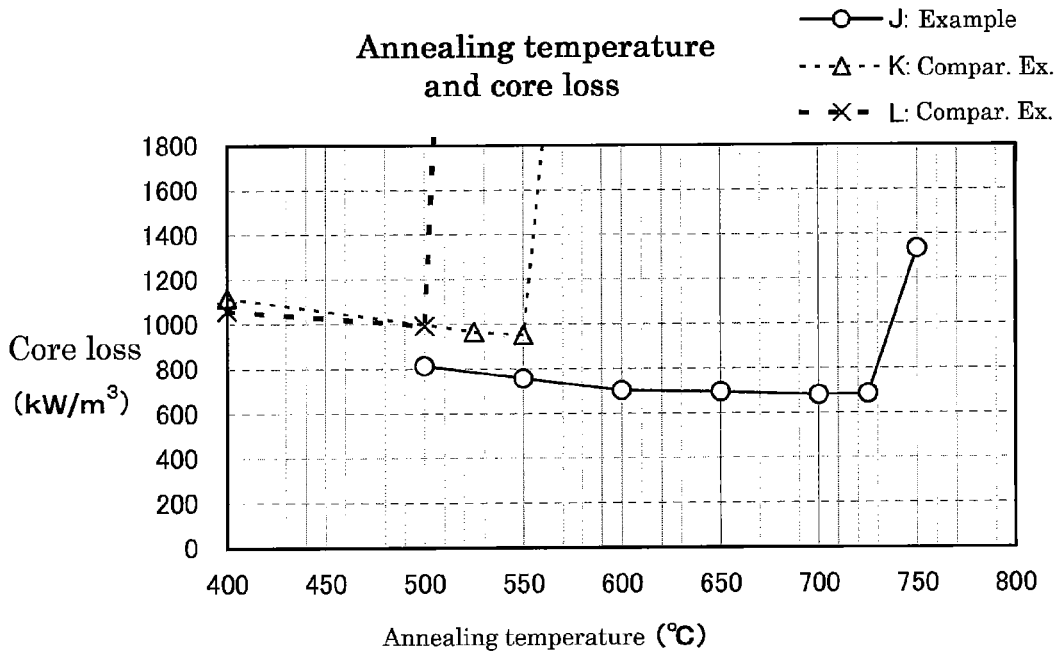
FIG. 9 is a diagram showing a relationship of the core loss with respect to the annealing temperature in a fifth characteristics comparison.
Figure 10:
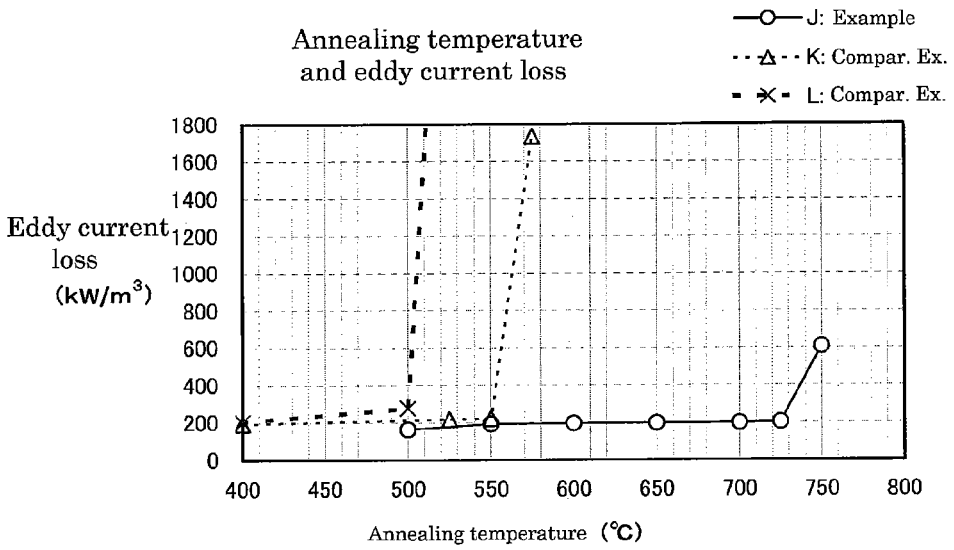
FIG. 10 is a diagram showing a relationship of the eddy current loss with respect to the annealing temperature in a fifth characteristics comparison.
Figure 11:
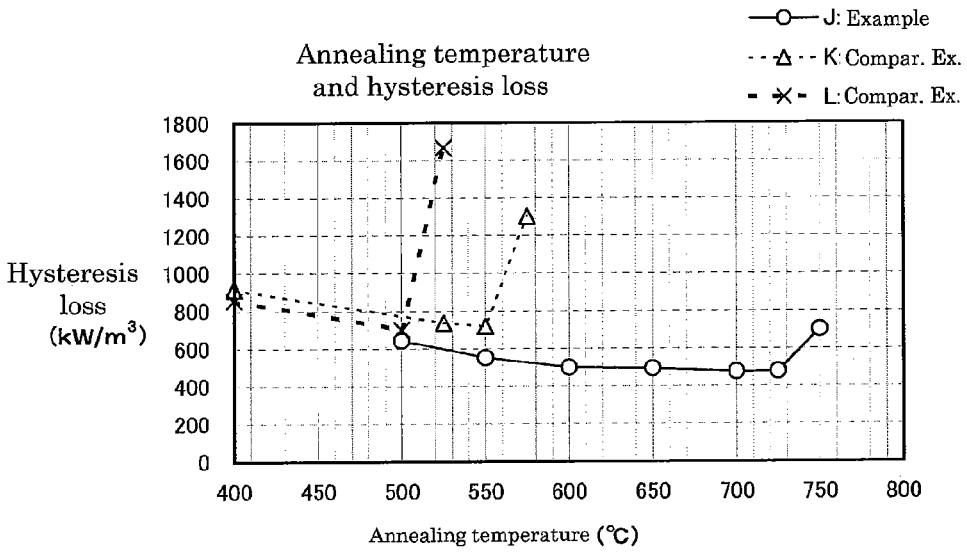
FIG. 11 is a diagram showing a relationship of the hysteresis loss with respect to the annealing temperature in a fifth characteristics comparison.

As can be seen from FIG. 10, the insulation film (L) is partially broken upon molding, and is subject to breakage in annealing process. Therefore, when the dust core is annealed at high temperature, the eddy current loss is largely increased. Even if the binder (K) is mixed, the eddy current loss is also increased at 550° C. or more. In contrast, in Example (J) using the fine powder, the eddy current loss can be reduced even if annealed at 725° C. Similarly, with regard to the core loss show in FIG. 9 as well as the hysteresis loss shown in FIG. 11, characteristics of Example (J) are excellent.

[3-6. State of Soft Magnetic Powder and Inorganic Insulating Powder]

Figure 12:
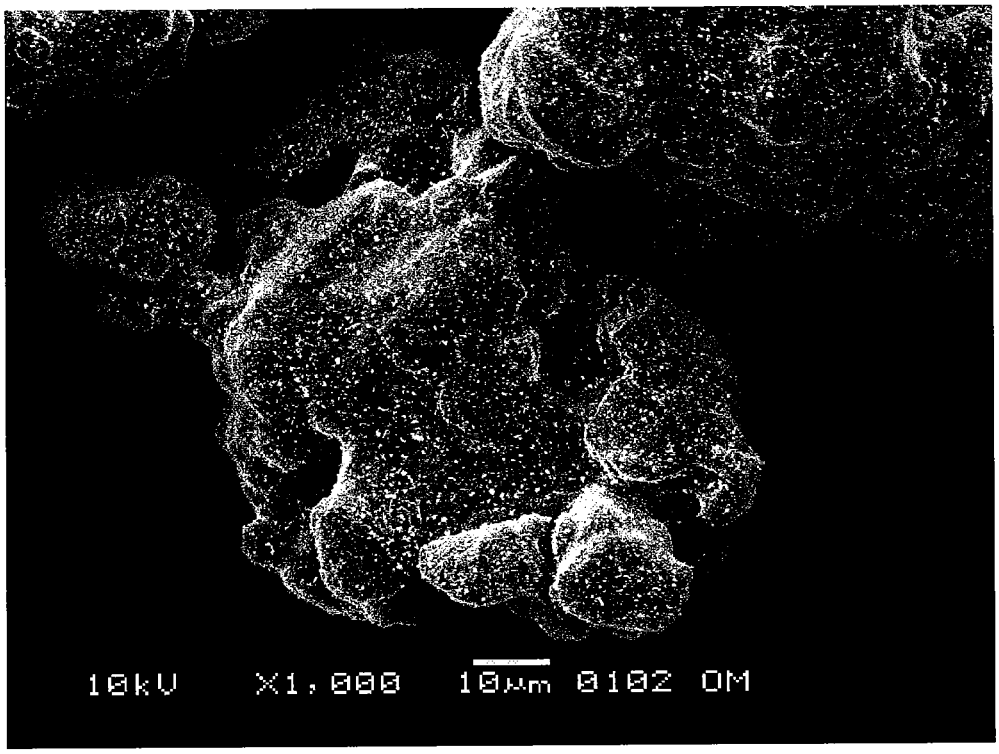
FIG. 12 is a SEM photograph substitute for drawing which shows a state in which inorganic insulating fine powders are attached on soft magnetic powder particles.
Figure 13:
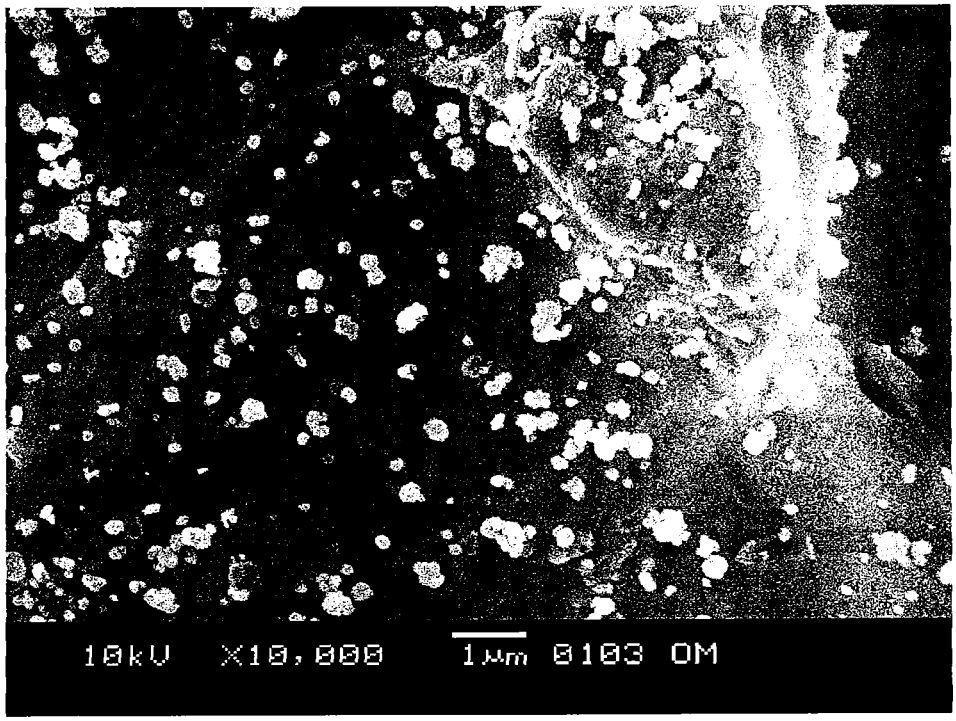
FIG. 13 is a SEM photograph substitute for drawing which has been enlarged from the SEM photograph of FIG. 12.

Composition of the granulated body formed by the soft magnetic powder and the inorganic insulating powder in one of the above Examples will be shown in SEM images and element analysis result. FIG. 12 is an image showing a state in which water-atomized pure iron powders were mixed with 0.5 wt %—insulating fine powders (alumina powders) having average particle size 13 nm and specific surface area 100 $m^2/g$. White dots are insulating fine powders. FIG. 13 is an enlarged image of FIG. 12, and white dots as shown are also insulating fine powders.

Figure 14:
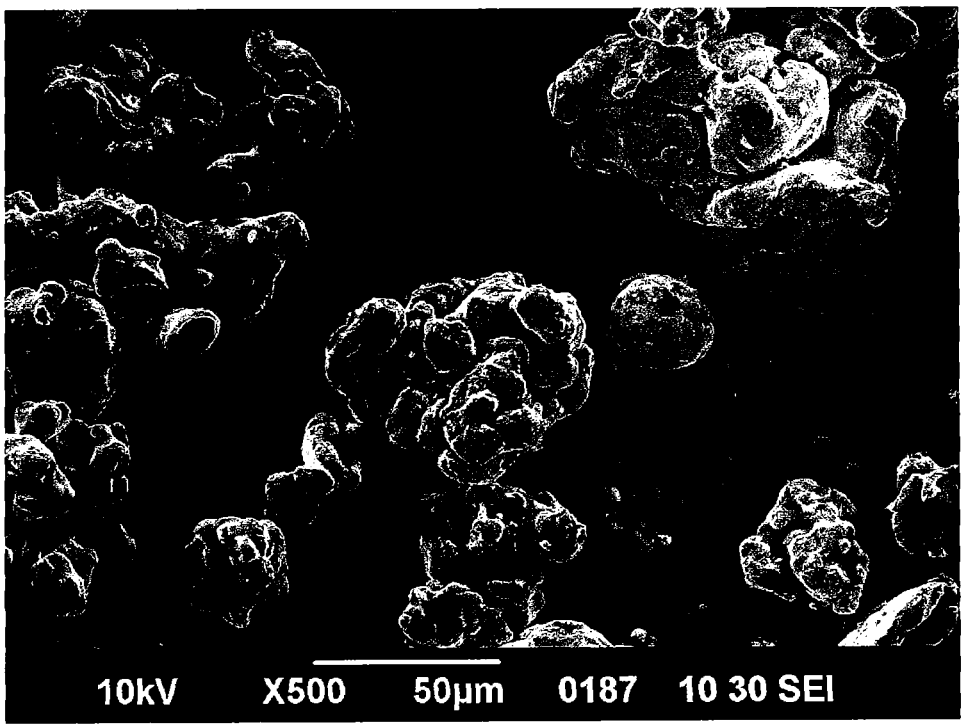
FIG. 14 is a SEM photograph substitute for drawing which shows a state where the soft magnetic powder particles attached with the inorganic insulating fine powders are granulated.

FIG. 14 shows a state in which the soft magnetic powders and the inorganic insulating powders shown in FIG. 12 were granulated by the binder process. As can be seen from FIG. 14, Plurality of soft magnetic powders shown in FIG. 12 are bonded to each other. In FIG. 14, each shape of the soft magnetic powders are clearly recognized, and whole surfaces were not covered by the binder. From FIG. 14, it is recognized that in the granulated body of the present Examples, respective soft magnetic powders are bonded to each other by the binder at their contacting portion as point, as linear, or as any small area. There can be seen portions in which insulating fine powders shown in FIG. 12 and FIG. 13 are exposed.

Figure 15:
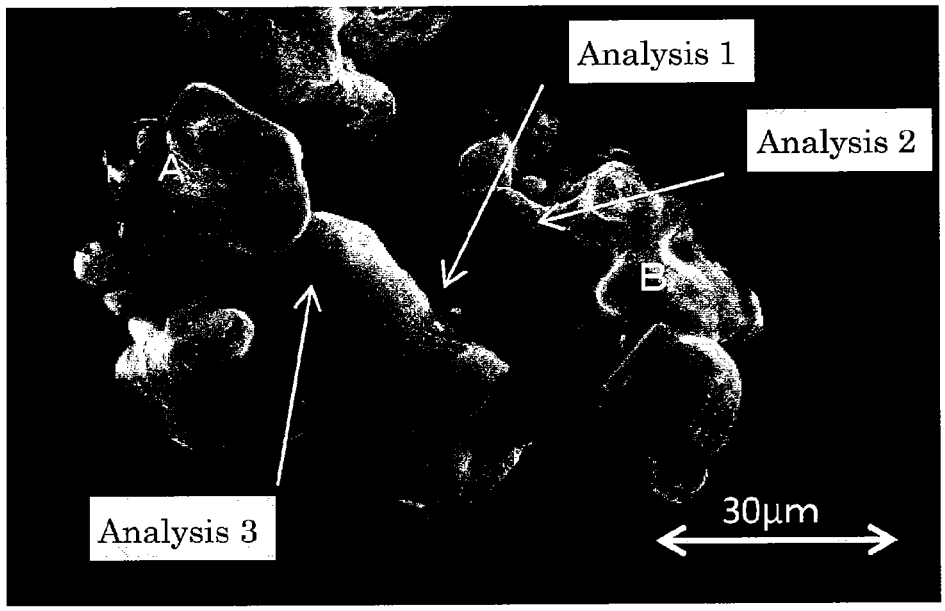
FIG. 15 is a graph showing the analysis result of a SEM photograph substitute for drawing which shows respective structures in a state where the soft magnetic powder particles attached with the inorganic insulating fine powders are granulated.

FIG. 15 and the following Table 6 shows element analysis results regarding respective portions of the granulated body shown in FIG. 15. That is, the element analysis is made at 10 kV SEM Acceleration Voltage (resolution of point analysis 0.3 μm (with respect to Fe)), in a state where the powders A and B shown in FIG. 15 are bonded to each other by the binder (i.e. the binder is existed in the contacting portion). Further, the element analysis is made at the following three portions:

(1) Analysis 1 . . . a portion on the binder;

(2) Analysis 2 . . . a portion 1 where the binder was not existed (on an alumina powder); and (3) Analysis 3 . . . a portion 2 where the binder was not existed.

Furthermore, Fe powder is used as an material, alumina added amount is 0.5 wt % to Fe powder, primary particle size of alumina is 13 nm, the binder added amount is 2.0 wt % to the Fe powder, and the binder is made of silicon resin.

TABLE 6

| | wt % | | | |
|---|---|---|---|---|
| | Fe | Si | Al | O |
| Analysis 1 | 10.20 | 74.00 | 2.55 | 13.22 |
| Analysis 2 | 46.44 | — | 35.36 | 18.20 |
| Analysis 3 | 72.06 | — | 17.72 | 10.22 |

As shown in the above analysis results of Table 6, the binder component Si exists in Analysis 1 portion that is a connection portion between powders A and B. In contrast, the binder component Si cannot be seen in Analysis 2 and 3 portions in which the surfaces of powders A and B were exposed. Furthermore, it is an important thing that in Analyses 2 and 3 portions in which the surfaces of powders A and B were exposed, aluminum, which is a constituent element of the insulating fine powder alumina, can be observed in a larger amount than the connection portion in Analysis 1.

The invention claimed is:

1. A method for manufacturing a dust core comprising:

a first mixing process for mixing a soft magnetic powder and an inorganic insulating powder;

a heating process for heating a mixture of the soft magnetic powder and the inorganic insulating powder;

a binder addition process for adding a silane coupling agent and a silicone resin as a binder resin to the mixture of the soft magnetic powder and the inorganic insulating powder heated in the heating process;

a second mixing process for mixing a lubricant resin with a mixture of the soft magnetic powder, the inorganic insulating powder, the silane coupling agent and the silicone resin;

a molding process for compression-molding a mixture of the soft magnetic powder, the inorganic insulating powder, the binder resin, and the lubricant resin so as to form a mold; and an annealing process for annealing the mold, wherein an added amount of the inorganic insulating powder is 0.4-0.8 wt % with respect to the soft magnetic powder, the heating process is performed in a non-oxidizing atmosphere at 1000° C. or more and also below a sintering temperature of the soft magnetic powder.

2. The method for manufacturing a dust core according to claim 1, wherein the soft magnetic powder has an average particle size of 5-30 μm, and contains 0-6.5 wt % silicon.

3. The method for manufacturing a dust core according to claim 2, wherein the inorganic insulating powder is $Al_2O_3$ powder or MgO powder having a melting point of 1500° C. or more, and has an average particle size of 7-500 nm.

4. The method for manufacturing a dust core according to claim 1, wherein the inorganic insulating powder is $Al_2O_3$ powder or MgO powder having a melting point of 1500° C. or more, and has an average particle size of 7-500 nm.

5. The method for manufacturing a dust core according to claim 1, wherein the soft magnetic powder is prepared by a gas atomization method, a water/gas atomization method, or a water atomization method.

6. The method for manufacturing a dust core according to claim 5, wherein the soft magnetic powder is prepared by the water atomization method and formed by a planarization treatment.

7. The method for manufacturing a dust core according to claim 1, wherein in the binder addition process, the silane coupling agent is added firstly and the silicone resin is added secondly to the mixture of the soft magnetic powder and the inorganic insulating powder heated in the heating process.

8. The method for manufacturing a dust core according to claim 1, wherein an added amount of the silane coupling agent is in a range of 0.1-0.5 wt % with respect to the soft magnetic powder and an added amount of the silicone resin is in a range of 0.5-2.0 wt % with respect to the soft magnetic powder.

9. The method for manufacturing a dust core according to claim 1, wherein a mixing amount of the lubricant resin is 0.2-0.8 wt % with respect to the soft magnetic powder.

10. The method for manufacturing a dust core according to claim 1, wherein an aspect ratio of the soft magnetic powder is between 1.0-1.5.

* * * * *